United States Patent [19]

Heiser et al.

[11] 4,120,233

[45] Oct. 17, 1978

[54] HYDRAULIC CONTROL SYSTEM FOR AT LEAST TWO CONSUMERS

[75] Inventors: Joachim Heiser, Stuttgart; Wolfgang Bernhardt, Korntal; Roland Schempp, Abstatt, all of Fed. Rep. of Germany

[73] Assignee: Robert Bosch GmbH, Stuttgart, Fed. Rep. of Germany

[21] Appl. No.: 809,936

[22] Filed: Jun. 24, 1977

[30] Foreign Application Priority Data

Jul. 7, 1976 [DE] Fed. Rep. of Germany ..... 2630468

[51] Int. Cl.[2] ..... F15B 11/16

[52] U.S. Cl. ..... 91/511; 91/518; 91/521; 91/459; 60/484; 60/DIG. 2

[58] Field of Search ..... 91/411 R, 412, 414, 91/459; 60/484, DIG. 2

[56] References Cited

FOREIGN PATENT DOCUMENTS 2,461,021 6/1976 Fed. Rep. of Germany.

*Primary Examiner*—Edgar W. Geoghegan

*Attorney, Agent, or Firm*—Michael J. Striker

[57] ABSTRACT

Each consumer is provided with a load-compensated direction-reversing valve. Each valve performs a throttling function and a pressure-compensation function in order to establish a selected volumetric flow rate, and also a direction-control function. Each valve comprises a first control valve stage and a second control valve stage. One stage performs the throttling function, the other the pressure-compensation function. One of the two control valve stages also performs the direction-control function. The pressure drop across the stage which performs the throttling function at least in part controls the setting of the stage which performs the pressure-compensation function. Each valve is provided with an electromechanical transducer generating electrical signals indicative of the settings of the stage which performs the pressure-compensation function. These signals are evaluated by an electrical information-processing unit, and the results of the evaluations are used to automatically adjust the setting of a line pressure regulating valve.

10 Claims, 2 Drawing Figures

HYDRAULIC CONTROL SYSTEM FOR AT LEAST TWO CONSUMERS

BACKGROUND OF THE INVENTION

The present invention relates to an hydraulic control system which controls the flow of fluid to at least two consumers. Associated with each consumer is a pressure-compensated direction-reversing valve. Each valve performs a throttling function and a pressure-compensation function to establish a selected volumetric flow rate, and also a direction-control function.

German published patent application DT-OS 24 40 099 discloses a control system of this general type in which, in order to avoid energy losses, the output power of the pump of the control system is automatically adjusted to meet the prevailing demand of the system. In that system, the control spools of all direction-reversing valves are arranged one after the other between the pump (which is of adjustable per-cycle volumetric throughput) and the tank, and provided between the last control spool and the tank is an adjustable constrictor, the pressure drop across which is used to control an auxiliary control valve, which in turn effects adjustment of the per-cycle volumetric throughput of the pump. This purely hydraulic system has the disadvantage that the expense for the hydraulic lines is relatively high. Also, the system tends to be inexact and somewhat insensitive in operation. Above all, the system does not operate reliably during reversals of flow direction.

SUMMARY OF THE INVENTION

It is a general object of the invention to provide a control system of the general type in question which is, however, of inherently simpler design, particularly when the hydraulic lines of the system must be spread out over a considerable distance, which makes use of standard hydraulic control system components of simple and inexpensive types, and which operates very reliably. Above all, it is an object to provide a system which is operative, and reliably operative, during load direction reversals.

These objects can be met by constructing each load-compensated direction-reversing valve from two control valve stages. One stage performs the aforementioned throttling function, the other the aforementioned pressure-compensation function, and one of the two stages also performs the direction-control function. Each load-compensated direction-reversing valve is provided with an electromechanical transducer. The transducer senses the settings of the control valve stage which performs the pressure-compensation function and generates corresponding electrical signals. The electrical signals are evaluated by an electrical information-processing unit, and the result of the evaluations are automatically employed to adjust the setting of a line pressure regulating device.

Advantageously, the pressure drop across the valve stage performing the throttling function is used to control or modify the setting of the valve stage performing the pressure-compensation function.

The electromechanical transducers employed can be, as explained in detail below, either simple double limit switches or, if greater exactness of operation is desired, analog-operating inductive transducers.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
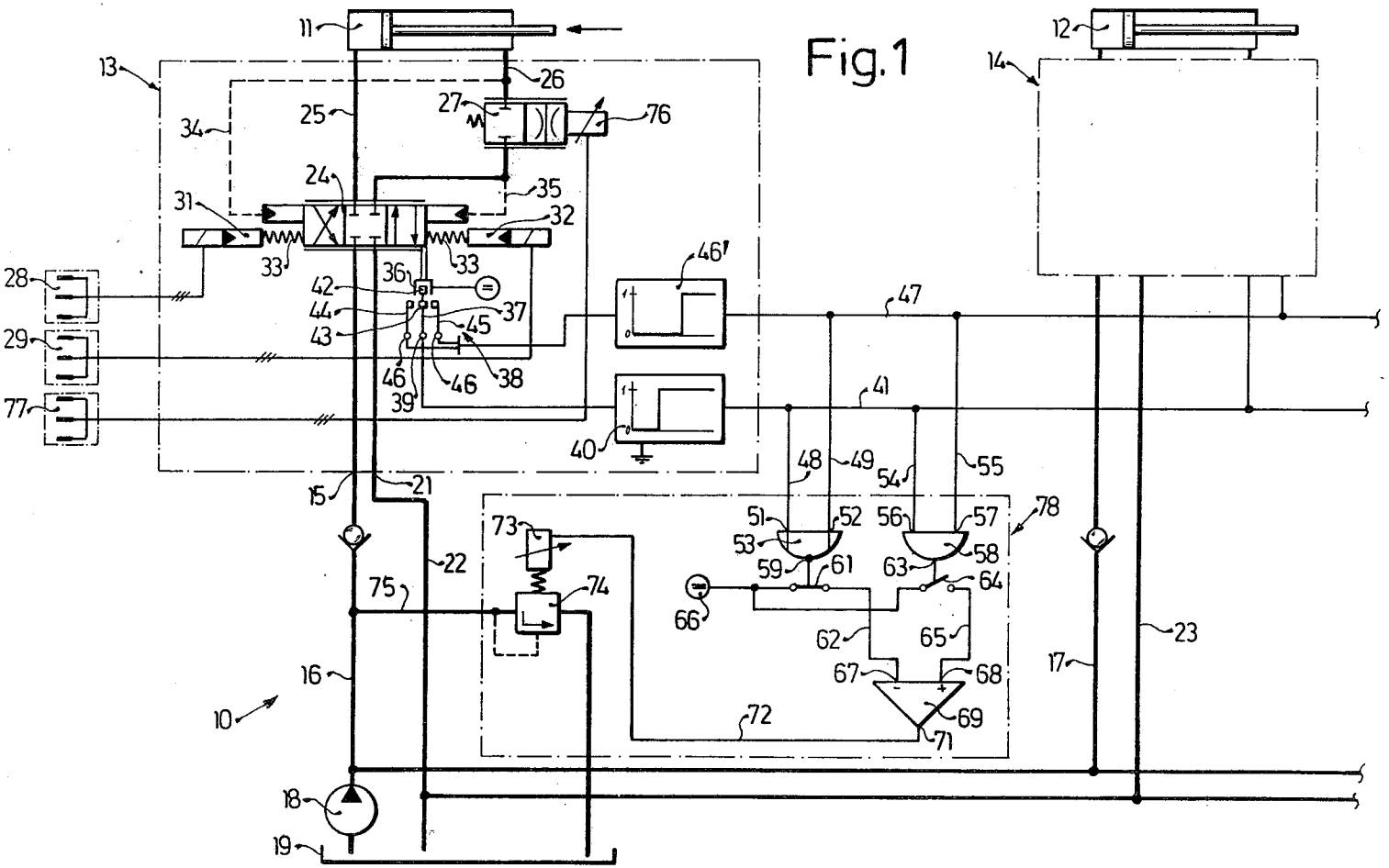
FIGS. 1 and 2 depict two exemplary hydraulic control systems embodying concepts of the invention.

FIG. 1 depicts a control system 10 for a first and a second hydraulic consumer 11, 12. Associated with each of the two consumers is a respective one of two load-compensated direction-reversing valves 13 and 14. The two direction-reversing valves 13, 14 are identically constructed, so that only the structural details of the first valve 13 need be described. The inflow conduit 15 of each direction-reversing valve 13, 14 is connected via parallel pressure lines 16, 17 to a pump which sucks pressure fluid from a tank 19. The pump 18 is preferably a simple and inexpensive pump of non-adjustable per-cycle volumetric throughput. A return-flow conduit 21 of each of the two valves 13, 14 is likewise connected to the tank 19, via respective return-flow lines 22, 23.

The direction-reversing valve 13 comprises a first control valve stage 24 which controls both a first work line 25 and a second work line 26 connected to opposite working chambers of the consumer 11. Connected in the second work line 26 is a second control valve stage 27.

The load-compensated direction-reversing valve 13 performs three functions. First, it determines the direction of flow. Second, it determines the smallest flow-cross-section in the system. Third, it determines the line pressure from the pump. The establisment of the smallest flow cross-section in the system (one of the two factors determining the volumetric flow rate) is referred to herein as the throttling function. The establishment of the line pressure of fluid delivered by the pump to the direction-reversing valve (the other of the two factors determining the volumetric flow rate) is referred to herein as the pressure-compensation function.

In the control system depicted in FIG. 1, the first control valve stage 24 performs both the direction-control function and also the pressure-compensation function; the second control valve stage 27 performs the throttling function.

The first control valve stage 24 is electrohydraulically piloted, and is provided with two electrical inputs 28, 29. To perform its pressure-compensation function, the first control valve stage 24 (e.g., the control valve member or control slide therein) is centered by centering springs 33 between its electrohydraulically actuated control pistons 31, 32. Additionally, the first control valve stage 24 is controlled, via control lines 34, 35, by the pressure drop across the second control valve stage 27.

The first control stage 24 can assume, in addition to a middle blocking setting and non-blocking end settings, any flow-throttling intermediate setting, as symbolically indicated in the drawing.

The first control valve stage 24 is provided with a groove 36. In terms of construction, this groove 36 may for example be an annular groove in the control spool within valve stage 24. Projecting into this groove is one end of a resilient contact blade 37, the other end of which is clamped stationary. Contact blade 37 forms part of a double limit switch 38. A first output 39 of double limit switch 38 is connected, via a first converter stage 40, to a first common line 41. The contact blade 37 carries a first contact 42 which cooperates with the electrically conductive surface of groove 36; in addition, contact blade 37 carries a second contact which cooperates with two resilient contacts 44, 45. The outputs of the two contacts 44, 45 are both denoted by 46, and are connected together.

The two outputs 46 are connected, via a second converter stage 46', to a second common line 47. The two common lines 41, 47 are connected, via electrical lines 48 and 49, to the inputs 51, 52 of a NOR-gate 53 and, via electrical lines 54 and 55, to the inputs of an AND-gate 58. The output 59 of NOR-gate 53 controls the setting of a first electric switch 61 connected in a first branch line 62. The output of AND-gate 58 controls the setting of a second electric switch 64 connected in a second branch line 65. The first branch line 62 leads from a D.C. current source 66 to a first, inverting input 67 of an integrating circuit 69 (e.g., an operational-amplifier Miller integrator having inverting and non-inverting inputs). The second branch line 65 leads, in parallel to the first branch line 62, from the D.C. current source 66 to the second, non-inverting input 68 of integrating circuit 69.

The output 71 of integrator 69 is connected via a line 72 to the control magnet 73 of a proportionally adjustable pressure-regulating valve 74. Pressure-regulating valve 74 is connected in a relief line 75 which branches off from the pressure line 16.

The second control valve stage 27 is controlled by a proportional magnet 76 which has an electrical input 77; i.e., the setting of control valve stage 27 is proportional to the energization of magnet 76.

The outputs of the (non-illustrated) double limit switch associated with the second direction-reversing valve 14 are connected to the common lines 41, 47 in the same manner as for the first direction-reversing valve 13.

NOR-gate 53, AND-gate 58, the electric switches 61, 64 and the integrator 69 are parts of an electrical information-processing unit 78.

German published patent application DT-OS 24 61 021 discloses structural details of a valve corresponding to the first direction-reversing valve 13; that valve is likewise comprised of a first control valve stage which performs the direction-control and pressure-compensation functions, and a second control valve stage which performs the throttling function.

The operation of the control system depicted in FIG. 1 is as follows:

Each of the two direction-reversing valves 13, 14 is controlled by a (non-illustrated) small and portable electrical control device having a (non-illustrated) control lever. The control lever has a middle or zero-volumetric-flow-rate position, and can be displaced therefrom in either direction to non-zero-volumetric-flow-rate positions.

When the control system 10 is set into operation, the first control valve stage 24 will be in its illustrated middle or blocking setting, and the second control valve stage 27 in its illustrated blocking setting. The double limit switch 38 furnishes no signals to the common lines 41, 42 for transmission to the logic circuits 53, 58. Accordingly, NOR-gate 53 maintains first switch 61 closed, whereas AND-gate 58 maintains second switch 64 open. Therefore, the first input 67 of integrator 69 receives a signal from current source 66 and so controls the magnet 73, that the pressure-regulating valve 74 is caused to assume its lowest-pressure setting, which may amount to a few bar.

The line pressure which pressure-regulating valve 74 establishes when it is in its lowest-pressure setting is just sufficient to assure that the piloted first control valve stage 24 can be caused to leave its middle setting against any resisting forces which may be present (e.g., spring forces, frictional forces, and the like). Accordingly, pump 18 delivers pressure medium against only this lowest settable pressure — i.e., so long as the first control valve stages 24 of the two direction-reversing valves 13, 14 are in their middle or blocking settings.

If now the control lever is moved out of its middle or zero-volumetric-flow-rate position to one side, then, for example by means of the electrical input 28, the first control valve stage 24 is electrohydraulically piloted, and it is moved by its control piston 31 through the intermediary of spring 33 in rightward direction, into an operative (non-blocking) setting. Simultaneously, an electrical signal is applied via electrical input 77 to the control magnet 76 of second control valve stage 27; as a result, second control valve stage 27 assumes a throttling setting proportional to the amount of shifting of the control lever relative to the zero-volumetric-flow-rate position of the control lever.

Accordingly, as soon as the prevailing load pressure is overcome, pressure medium flows from the pump 18 through the first control valve stage 24, the second work line 26 and the second control valve stage 27, to the consumer 11 and, via the first work line 25, the first control valve stage 24 and the return-flow line 22 to the tank 19.

The pressure drop resulting across the second control valve stage 27 is transmitted via the control lines 34, 35 and acts upon the first control valve stage 24 in opposition to the precompression of spring 33 established by control piston 31, thereby making it possible for the control valve stage 24 to perform its pressure-compensation function (defined above).

Returning to the start, as soon as the control lever is moved out of its zero setting, the control piston 31 begins to move first control valve stage 24 out of its middle or blocking setting. When the setting of stage 24 has changed to a very small predetermined extent, the first contact 42 comes into electrically conductive engagement with the groove 36. Via the first output 39 and the converter stage 40, a signal is applied to the first common line 41, and transmitted to input 51 of NOR-gate 53 and to input 56 of AND-gate 58.

As a result, NOR-gate 53 causes switch 61 to open; switch 64, which was already open, remains open. Accordingly, no input signal is applied to integrator 69, so that the output signal thereof remains constant at the value it had just before switch 61 opened. Thus, the pressure-regulating valve 74 is "locked-in" to the previously established lowest-pressure setting thereof, and continues to maintain the corresponding line pressure value.

As the first control valve stage 24 begins to leave its middle or blocking setting, the line pressure is still at the lowest-pressure value. Accordingly, the pressure drop across second control valve stage 27 is correspondingly low, and insufficient to oppose the action of control piston 31. Therefore, control piston 31 moves the first control valve stage 24 all the way to its extreme (fully open) setting.

When first control valve stage 24 reaches its extreme (fully open) setting, second contact 43 electrically engages contact 45. From output 46, a signal is transmitted via converter stage 46', second common line 47, and the lines 49 and 55, to the inputs 52 and 57 of the logic gates. The first switch 61 remains open; the second switch 64 closes, because signals are now present at both inputs 56, 57 of AND-gate 58. Accordingly, a signal is transmitted via branch line 65 to the non-inverting input 68 of integrator 69, causing the setting of pressure-regulating valve 74 to be changed to higher and higher pressure settings. The resultant line pressure rise can reach the maximum possible value in a time as short as about 1/10 of a second. However, in general, the maximum possible line-pressure value is not reached.

Specifically, as the line pressure rises, the pressure drop across second control valve stage 27 rises correspondingly, due to the increase in volumetric flow rate. When the volumetric flow rate corresponding to the selected position of the control lever has been reached, the actual pressure drop across second control valve stage 27 will be strong enough to begin to move first control valve stage 24 out of its extreme (fully open) setting and back toward its middle setting.

However, as soon as control valve stage 24 has moved a predetermined small amount out of its extreme (fully open) setting, the signal at output 46 of double limit switch 38 disappears, so that the line pressure rise under discussion terminates. Specifically, as soon as control valve stage 24 has left its extreme setting, switch 64 opens again, so that no input signal is applied to integrator 69; accordingly, pressure-regulating valve 74 is now locked in that pressure setting which it had as control valve stage 24 began to leave its extreme setting.

The switchover points of limit switch 38 are so matched to the stroke of the control spool (or the like) of the first control valve stage 24 that, at constant load, the control valve stage 24 is as near as possible to its fully open setting, in order to minimize energy losses.

To summarize this sequence of events:

Initially, the (non-illustrated) control lever is in the zero setting, for zero volumetric flow rate; accordingly, the pressure-regulating valve 74 is locked into its lowest-pressure setting. When the control lever is moved to a non-zero setting, the stage 24 moves from its middle setting to an extreme setting. When the extreme setting is reached, there commences a fast rise in the line pressure. During this fast rise in line pressure, stage 24 begins to leave its extreme setting and return towards its middle setting. As soon as the rising line pressure has reached a value such that the pressure drop across stage 27 indicates that the selected volumetric flow rate has been reached, the line pressure rise is terminated. At this point, stage 24 will still be very near its fully open setting. The steady state of the control system has been achieved.

From the foregoing, persons familiar with electrohydraulic control systems will understand the operation of the system in other conditions, E.g., if the load pressure of the consumer 11 now decreases, the signal at the first output 39 of limit switch 38 disappears, the switch 61 closes again, and there commences a line pressure drop towards the lowest-pressure value, but this line pressure drop terminates before the lowest-pressure value is reached, i.e., to form the new steady state of the system. Likewise, if the load pressure of the consumer increases, there occurs an automatic increase in the setting of the pressure-regulating valve 74, to effect an automatic compensatory increase in the line pressure and thereby maintain the volumetric flow rate at the selected value.

Since the degree of flow restriction (throttling) effected by the second control valve stage 27 is determined by the setting of the (non-illustrated) control lever, one can select any desired volumetric flow rate between zero and the maximum value of which the system is capable.

Furthermore, irrespective of the volumetric flow rate determined by the setting of second stage 27, the setting of the direction-control and pressure-compensation first stage 24 will, in the steady state, always be as near to fully open as possible, so that the pressure loss for the desired volumetric flow rate will be kept as low as possible. This is because valve stage 24 controls the line pressure indirectly, by terminating the adjustment of pressure-regulating valve 74 when the line pressure has reached the correct value for the selected volumetric flow rate.

Accordingly, the control of fluid delivery to the consumer, besides being load-pressure compensated, is furthermore performed with the lowest possible energy losses.

If both direction-reversing valves 13, 14 are in operation and furnish signals to the electrical information-processing unit 78, then the latter inherently singles out the input signal which commands a line pressure increase, or the greater line pressure increase if the signals from both valves 13, 14 are commanding a line pressure increase. Thus, the setting of pressure-regulating valve 74 will automatically be changed to a value establishing a line pressure meeting the requirement of whichever one of the two valves 13, 14 is placing the higher demand. In that event, the valve 13 or 14 associated with the lower load pressure, has its associated first control stage 24 in a setting corresponding to the selected volumetric flow rate. Any signals originating from this lower-demand valve have no effect upon the control system 10, so long as an input signal is present at input 52 of NOR-gate 53. In this way, in the control system 10, the pressure is always automatically caused to assume a value slightly above the respective maximum load pressure, so that unnecessary energy losses will not develop. Furthermore, the direction-reversing valves 13, 14 operate not only under positive loading, but also under negative loading. If the direction of fluid delivery is reversed, the first control stage 24 of the affected valve(s) returns toward its middle setting, resulting in a line pressure decrease.

Figure 2:
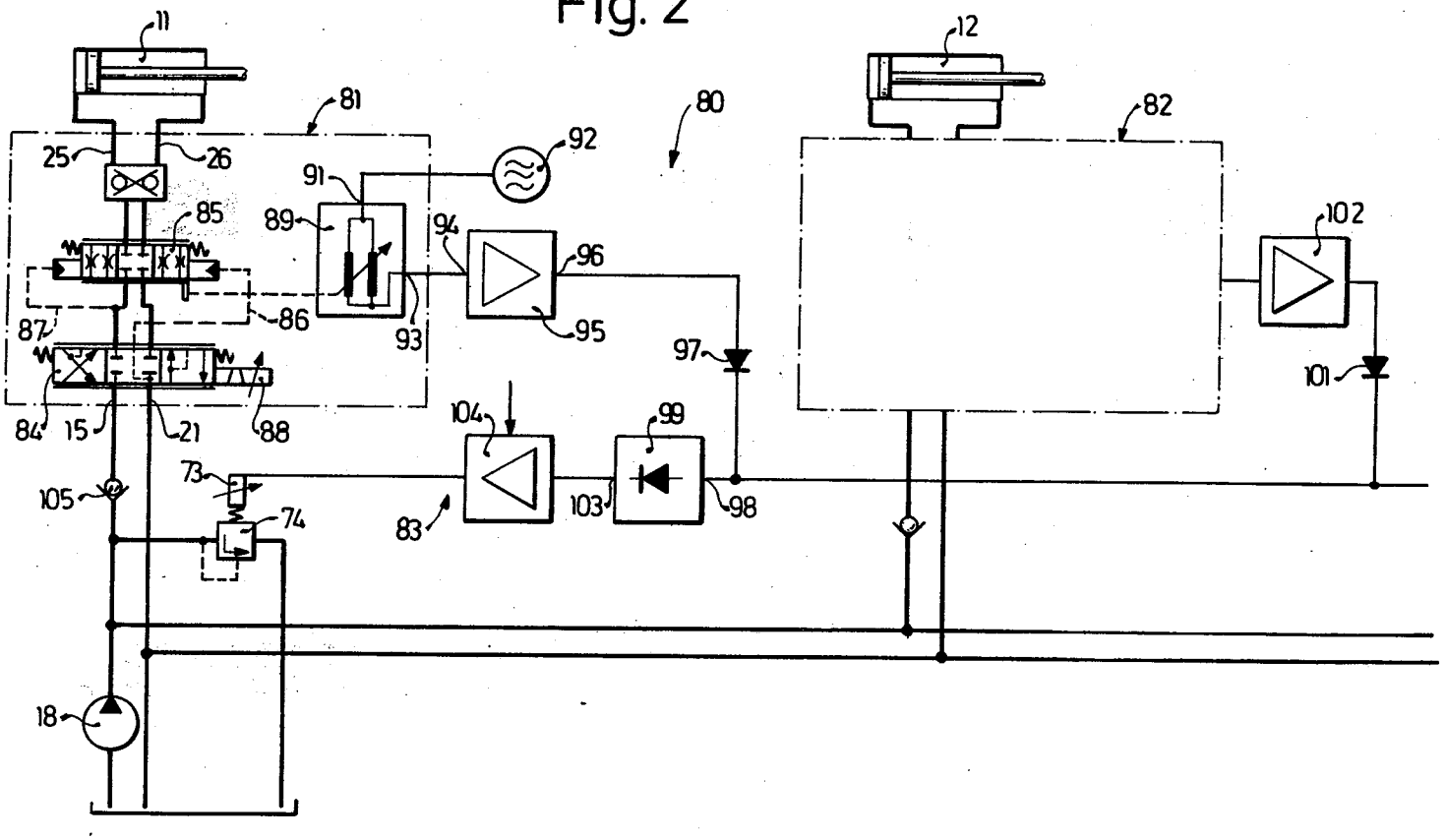

FIG. 2 depicts a second control system 80 differing from that of FIG. 1 mainly in a different construction of its two (identical) direction-reversing valves 81, 82 and in the construction of its electrical information-processing unit 83. Components in FIG. 2 corresponding to those in FIG. 1 are denoted by the same reference numerals as in FIG. 1.

The first direction-reversing valve 81 comprises a first control valve stage 84 which, in this embodiment, performs the direction-control function and the throttling function (both defined earlier) and also a second control valve stage 85 which performs the pressure-compensation function (likewise defined earlier). Second stage 85 is connected in the two work lines 25, 26. First stage 84 controls the four ways (port lines) for the work lines 25, 26, the inflow line 15 and the return-flow line 21, and also a fifth way for a control line 86.

By means of the control line 86, one end of the second control valve stage 85 (i.e., one end of the control spool thereof, or the like) is relieved into the return-flow line 21, when the first control stage 84 is in its middle setting. The opposite end of second stage 85 is connected, via a second control line 87, to the first work line 25 at a point thereof between the two control stages 84 and 85.

The first control stage 84, besides its middle setting and its two extreme settings, can also assume any intermediate setting, in the course of performing the throttling function.

The first, spring-centered control stage 84 is controlled by a bidirectional proportional-acting magnet 88. When first control stage 84 leaves the middle setting, the first control line 86 is always connected to a point so located within the flow of pressure fluid passing through work lines 25, that the pressure drop across the first control stage 84 is applied via the control lines 86, 87 to the second control stage 85, to control the latter.

The second control stage 85 (which performs the pressure-compensation function) has a middle setting in which it fully opens the work lines 25, 26; additionally, it can assume settings to either side of its middle setting, so as to vary the smallest flow cross-section of the system in proportion to its displacement from the middle setting.

The second control stage 85 is mechanically coupled to the moving component of an inductive transducer 89, whose input 91 is connected to an oscillator 92 and whose output 93 is connected to the input 94 of an electrical control device 95. The output 96 of the electrical control device 95 is connected, via a diode 97, to the input of a high-precision rectifier 99, whose input is also connected via a second diode 101 to the output of an electrical control device 102 associated with the second direction-reversing valve 82. The output 103 of rectifier 99 is connected, via a proportional amplifier 104, to the control magnet of the pressure-regulating valve 74. Amplifier 104, rectifier 99, diodes 97, 101, electrical control devices 95, 102, and oscillator 92 together form an electrical information-processing unit 83.

The control system 80 of FIG. 2 operates as follows:

Each of the two direction-reversing valves 81, 82 is controlled by a (non-illustrated) control lever on a small portable remote-control unit (likewise not illustrated).

When the control system 80 is to be set into operation, the control lever first connects the electrical information-processing unit 83 to operating voltage. As a result, transducer 83 receives from oscillator 92 an A.C. signal, modulates it in dependence upon the setting (at this point, the middle setting) of second control valve stage 85, and furnishes the setting-modulated signal to the first electrical control device 95. In the latter, the signal is demodulated, filtered and amplified and furnished as a D.C. signal (after its transmission through diode 97 and precision rectifier 99) to the proportional amplifier 104. The latter sets pressure-regulating valve 74 for a pressure valve proportional to the signal.

The electrical information-processing unit 83 is so designed that, when the second control valve stage 85 is in its middle or blocking setting, the unit 83 causes a line pressure rise in the control system 80. Accordingly, to prevent the line pressure from rising to the maximum possible value when the system is not in operation, the information-processing unit 83 is not connected to operating voltage until the (non-illustrated) control lever leaves its zero-volumetric-flow-rate setting; however, as soon as the zero setting is left, the unit 83 is connected to power.

In any event, when the control lever is moved from its zero setting an electrical signal, corresponding in polarity and magnitude to the direction and magnitude of the desired volumetric flow rate, is applied to the bidirectional control magnet 88. As a result, first control valve stage 84 undergoes a change of setting in the appropriate direction and to a proportional extent.

To repeat, when the (non-illustrated) control lever is moved from its zero position, the information-processing unit 83 becomes activated (connected to operating voltage) and, so long as second stage 85 is in its middle setting, effects a line pressure rise. The line pressure rise occurs very fast; as soon as the load pressure of the consumer is overcome, pressure fluid commences to flow through check valve 105, the first and second control stages 84, 85 and into the first consumer 11.

The resulting pressure drop across the first control valve stage 84 (i.e., between a point upstream of the flow-constricting structure therein and a point downstream thereof) acts, via the control lines 86, 87, upon the second control valve stage 85, so that stage 85 can perform its pressure-compensation function. Specifically, second control valve stage 85 leaves its middle (unblocking) setting in one direction or the other, and assumes a throttling setting of such an extent as to tend to maintain the aforementioned pressure drop across stage 85 at a constant value. When stage 85 thusly leaves its middle setting, transducer 89 applies to information-processing processing unit 83 a signal causing the latter to lower the pressure setting of pressure-regulating valve 74. The electrical information-processing unit 83 is so designed that, if the load pressure is constant, the control system 80 adjusts the second control valve stage 85 to a setting in which its flow cross-section is smaller than its maximum flow cross-section (corresponding to its middle setting) by only a small predetermined amount. This serves to prevent unnecessary energy losses, because the system maintains the line pressure just slightly higher than the prevailing load pressure. Nevertheless, the consumer 11 receives pressure fluid at a volumetric rate whose magnitude is independent of load pressure and dependent only upon the flow cross-section to which the first control valve stage 84 is set.

If the two direction-reversing valves 81 and 82 are both activated, and if consumer 12 demands a higher pressure, then the signal generated by the second electrical control device 102 predominates and the pressure-regulating valve 74 is set to a corresponding setting. In that event, the second control valve stage 85 of the first direction-reversing valve 81 assumes a more constricted setting than it would otherwise do, in order to maintain the pressure drop across the first control valve stage 85 unchanged. The trnsducer 89 of the first valve 81 generates a signal commanding a line pressure decrease, but this signal has no effect upon the information-processing unit. The direction-reversing valve 81 operates not only under conditions of positive load, but also if a negative load appears during a direction reversal.

The control system 80 of FIG. 2 is of somewhat more expensive construction than that of FIG. 1, but it has the advantage of analog operation and accordingly very exact pressure control. Additionally, the transducer 89 can be arranged directly connected to and coaxial with the second control valve stage 85. The service life of the control system 80 is improved by the use of the contact-free inductive transducer 89.

It will be understood that each of the elements described above, or two or more together, may also find a useful application in other types of circuits and constructions differing from the types described above.

While the invention has been illustrated and described as embodied in two electrohydraulic control systems of particular type, it is not intended to be limited to the details shown, since various modifications and structural changes may be made without departing in any way from the spirit of the present invention.

Without further analysis, the foregoing will so fully reveal the gist of the present invention the others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an hydraulic control system for controlling the delivery of pressure fluid to at least two hydraulic consumers, in combination, a plurality of pressure-compensated direction-reversing valves, one for each consumer, each valve performing a direction-control function for determining the direction of flow of fluid in the system, a throttling function for determining the smallest flow cross-section in the system, and a pressure-compensation function for determining the line pressure in the system, each valve comprising first and second control valve stages of which one performs two of said functions and the other the remaining one of said functions; a plurality of electromechanical transducers, one for each of said valves, each transducer operative for sensing the setting of that one of the control valve stages of the associated valve which performs the pressure-compensation function and generating electrical signals dependent upon the sensed setting; line pressure regulating means operative for regulating the line pressure in the system; and an electrical information-processing unit operative for receiving said electrical signals, evaluating the same, and in dependence upon the results of the evaluations automatically adjusting the setting of the line pressure regulating means.

2. In an hydraulic control system as defined in claim 1, each valve including means for sensing the pressure drop across the control valve stage thereof which performs the throttling function and in dependence upon that pressure drop controlling the setting of the control valve stage which performs the pressure-compensation function.

3. In an hydraulic control system as defined in claim 2, each first control valve stage performing the direction-control function and the pressure-compensation function, each second control valve stage performing the throttling function, each electromechanical transducer comprising a double limit switch operative for sensing the setting of the first control valve stage and having at least a first and a second output for furnishing two different signals indicative of two different settings of the first control valve stage.

4. In an hydraulic control system a defined in claim 2, the electrical information-processing unit including a first common electrical line joining all first outputs of all double limit switches and a second common electrical line joining all second outputs of all double limit switches, a NOR-gate having first and second inputs respectively connected to said first and second common lines, an AND-gate having first and second inputs respectively connected to said first and second common lines, a first switch controlled by the output signal of the NOR-gate and a second switch controlled by the output signal of the AND-gate, and adjusting means operative independence upon the settings of the first and second switches for adjusting the setting of the line pressure regulating means.

5. In an hydraulic control system as defined in claim 4, the adjusting means comprising an electrical integrator having a first input connected to the first switch and a second input connected to the second switch and having an output connected to the line pressure regulating means for controlling the setting of the latter in dependence upon the settings of the first and second switches.

6. In an hydraulic control system as defined in claim 3, each first control valve stage having a middle blocking setting and to either side thereof unblocking settings, each double limit switch comprising a contact blade projecting into a groove provided in a component of the associated first control valve stage and operative when the first stage is in the middle setting for preventing the generation of signals on the first and second outputs of the double limit switch, and operative when the first stage leaves its middle setting for producing a signal on the first output of the double limit switch and then when the first stage leaves its middle setting to a greater extent producing a signal on the second output of the double limit switch.

7. In an hydraulic control system as defined in claim 2, wherein each first control valve stage performs the direction-control function and the throttling function, wherein each second control valve stage performs the pressure-compensation function, each electromechanical transducer comprising an inductive transducer operative for generating signals indicative of the setting of the associated second control valve stage.

8. In an hydraulic control system as defined in claim 7, including oscillator means for applying an oscillating signal to the inductive transducers, a plurality of electrical control devices each having an input connected to the output of a respective transducer, a plurality of rectifiers each having an input connected to the output of a respective electrical control device, and an amplifier having an input connected to the outputs of the rectifiers and having an output connected to the line pressure regulating means for automatically adjusting the setting of the letter.

9. In an hydraulic control system as defined in claim 8, further including a precision rectifier having an input connected to the outputs of said rectifiers and having an output connected to the input of said amplifier.

10. In an hydraulic control system as defined in claim 9, the control system comprising a pressure-fluid pump supplying pressure fluid to the remainder of the system, the pump being of non-adjustable per-cycle volumetric throughput.

* * * * *